US009487042B2

(12) United States Patent
Hiyoshi

(10) Patent No.: US 9,487,042 B2
(45) Date of Patent: Nov. 8, 2016

(54) IMAGE-FORMING APPARATUS, ERASING APPARATUS, AND SHEET-REUSE SYSTEM INCLUDING THESE APPARATUSES

(71) Applicants: KABUSHIKI KAISHA TOSHIBA, Tokyo (JP); TOSHIBA TEC KABUSHIKI KAISHA, Tokyo (JP)

(72) Inventor: Kimihiko Hiyoshi, Numazu Shizoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/816,828

(22) Filed: Aug. 3, 2015

(65) Prior Publication Data

US 2016/0067999 A1 Mar. 10, 2016

(30) Foreign Application Priority Data

Sep. 5, 2014 (JP) ..... 2014-180818

(51) Int. Cl.
*B41M 7/00* (2006.01)

(52) U.S. Cl.
CPC ..... *B41M 7/0009* (2013.01)

(58) Field of Classification Search
CPC ..... B41J 2/01; B41J 29/38; B41M 7/0009
See application file for complete search history.

(56) References Cited

U.S. PATENT DOCUMENTS

2010/0272449 A1* 10/2010 Yoshida ..... H04N 1/32133 399/2
2011/0234721 A1 9/2011 Endo
2011/0305851 A1* 12/2011 Wang ..... B41M 5/52 428/32.31
2013/0070265 A1 3/2013 Megawa et al.

FOREIGN PATENT DOCUMENTS

JP H05-289575 11/1993

* cited by examiner

*Primary Examiner* — Thinh Nguyen
(74) *Attorney, Agent, or Firm* — Patterson & Sheridan, LLP

(57) ABSTRACT

According to the embodiments, there is provided an erasing apparatus and an image-forming apparatus. The erasing apparatus prints a mark including printing information of a sheet before erasing processing on the sheet after erasing processing. The image-forming apparatus performs control such that an image to be printed is suppressed to be formed on an area on which a large number of images have been printed in the sheet before the erasing processing.

18 Claims, 8 Drawing Sheets

IMAGE-FORMING APPARATUS, ERASING APPARATUS, AND SHEET-REUSE SYSTEM INCLUDING THESE APPARATUSES

CROSS-REFERENCE TO RELATED APPLICATION

This application is based upon and claims the benefit of priority from the prior Japanese Patent Application No. 2014-180818, filed on Sep. 5, 2014, the entire contents of which are incorporated herein by reference.

FIELD

Embodiments described herein relate generally to an image-forming apparatus for forming an image on a sheet using an erasable color material, an erasing apparatus for erasing the image, and a sheet-reuse system including these apparatuses.

BACKGROUND

Recently, an erasing apparatus has been known that erases an image printed using an erasable color material. The erasable color material is a color material that is decolored, for example, by being heated at a predetermined temperature (hereinafter referred to as decoloring temperature). The erasing apparatus sequentially takes in a sheet on which an image has been printed with this decolorable material, and performs decoloring by heating the sheet at the decoloring temperature while pressurizing. The image is visually erased by being decolored.

In contrast, a conventional image-forming apparatus, when reusing a sheet to which the decoloring processing has been performed by the erasing apparatus for printing, performs printing processing without considering a previous use state (printing state) of the sheet. For example, the image-forming apparatus performs printing to the sheet in a state of being set to the image-forming apparatus by a user. Therefore, in the sheet to which the printing processing has been performed by the conventional image-forming apparatus, deviation may occur in a printing surface or a printing region. Further, when the printing is repeated to the same region of the sheet, due to overlapping of the color material, printing quality is decreased.

DETAILED DESCRIPTION

Figure 1:
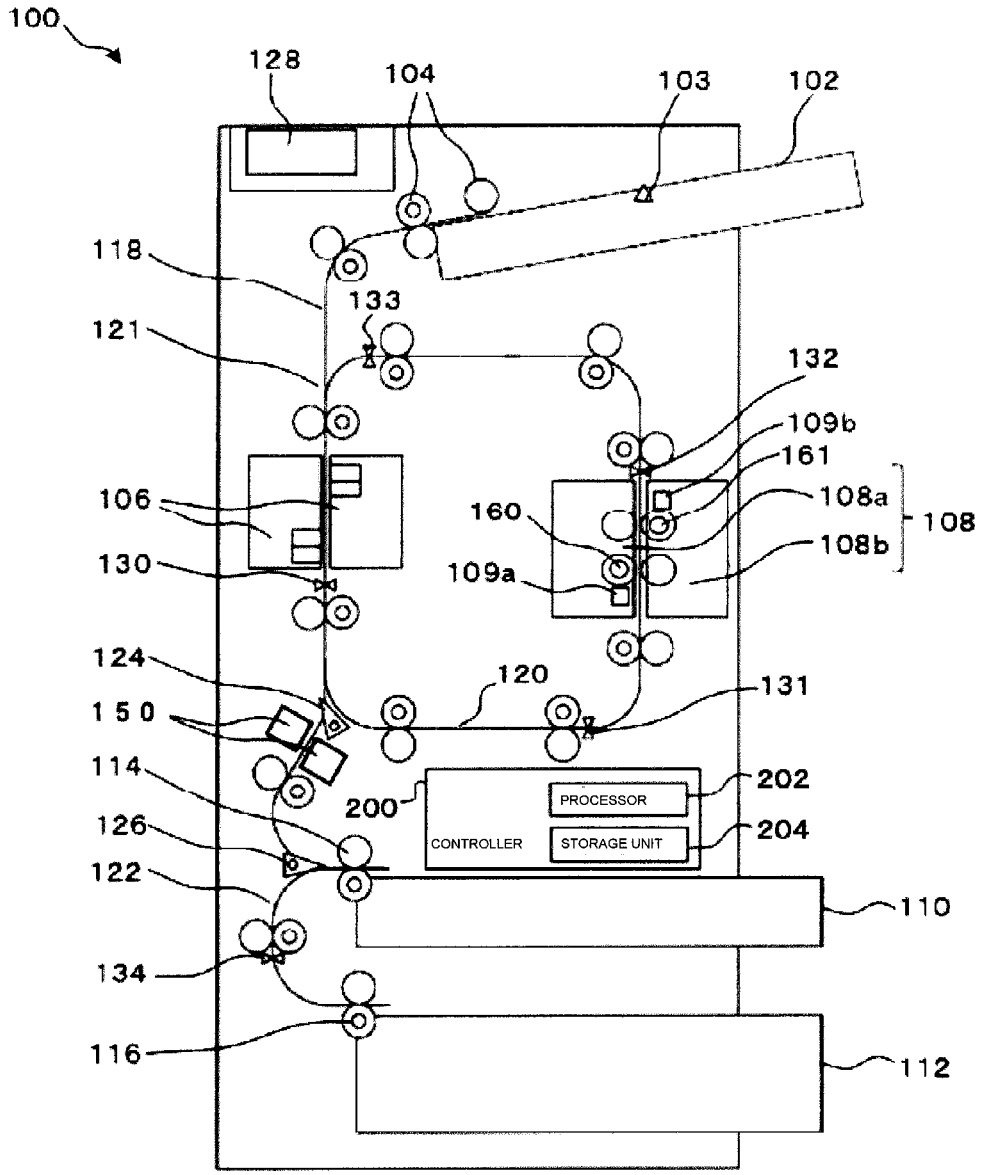
FIG. 1 is a schematic diagram illustrating an exemplary overall configuration of an erasing apparatus according to an embodiment.

According to one embodiment, a sheet-reuse system comprises an erasing apparatus, and an image-forming apparatus. The erasing apparatus includes a first reading unit, an erasing unit, a first controller, and a mark printing unit. The first reading unit reads an image printed on a sheet using an erasable color material. The erasing unit erases the image printed on the sheet. The first controller generates a mark including printing information representing an image printing state of at least one area of a plurality of areas of a surface of the sheet before an erasing processing by the erasing unit, based on the image read by the first reading unit. The mark printing unit prints the mark on the sheet. The image-forming apparatus includes an image-forming unit, a second reading unit, and a second controller. The image-forming unit forms an image to be printed using the erasable color material, on the sheet after the erasing processing by the erasing apparatus. The second reading unit reads the mark from the sheet after the erasing processing by the erasing apparatus, before image forming processing by the image-forming unit. The second controller acquires the printing information from the mark read by the second reading unit. Further, the second controller, based on the acquired printing information, performs control such that the image to be printed by the image forming unit is suppressed to be formed on the area on which a large number of images have been printed of the plurality of areas in the sheet before the erasing processing.

With the above configuration, for example, the erasing apparatus reads the sheet on which the image has been printed, before the erasing processing. The erasing apparatus, based on the reading result, detects a printing pattern representing which area or position includes the printed images. The erasing apparatus, based on the detection result, converts the printing information into a mark readable by a machine, for example a bar code, the printing information representing the area on which a large number of images have been printed of the plurality of areas of the surface of the sheet. The erasing apparatus prints an image of the bar code on the sheet after the erasing processing using an inerasable color material.

Further, with the above configuration, for example, the image-forming apparatus reads the image of the bar code printed on a printing sheet to be fed from a sheet-feeding unit, near the sheet-feeding unit. The image-forming apparatus, based on the printing information included in the image of the read bar code, detects a printing surface and printing area of which printing use frequency in the sheet is small. The image-forming apparatus, for example, changes rotation of the image data to be printed and the printing surface of the sheet to positively use the detected printing surface and printing area.

The image-forming apparatus can reduce an overlapping portion of the color material with the printing area used in a previous printing processing by performing rotation of the image data to be printed and the like as described above. Therefore, the image-forming apparatus of the embodiment can prevent decrease of printing quality when reusing the sheet multiple times and increase the number of times of reuse of the sheet.

Hereinafter, the embodiment will further be described with reference to the drawings. The same reference signs denote the same or similar components in the drawings.

FIG. 1 is a schematic diagram illustrating a configuration of the erasing apparatus. The erasing apparatus 100 illustrated in FIG. 1 erases the image printed on the sheet using the erasable color material. The erasing processing for erasing the image includes decoloring processing for visually erasing the image, for example, by decoloring the image. In the following embodiment, an example of decoloring the image will be described as the erasing processing. Therefore, in the following description, the erasing processing by the erasing apparatus 100 is referred to as the decoloring processing. The erasable color material includes a decolorable color material that is decolored, for example, by being heated at a predetermined decoloring temperature. In the following embodiment, an example will be described in which the decolorable color material is used as the erasable color material. Therefore, in the following description, the erasable color material is referred to as the decolorable color material. The decolorable color material includes, for example, a decolorable toner and a decolorable ink. The decolorable color material, specifically, includes a color developing compound, a color developing agent, and a decoloring agent. The color developing compound includes, for example, a leuco dye. The color developing agent includes, for example, phenols. The decoloring agent is a substance that is compatible with the color developing compound by being heated and does not have affinity with the color developing agent. The decolorable material develops color by an interaction between the color developing compound and the color developing agent, and is decolored since the interaction between the color developing compound and the color developing agent is interrupted by heating of more than the decoloring temperature.

As illustrated in FIG. 1, the erasing apparatus 100 includes a sheet-feeding tray 102, a sheet-feeding member 104, a reading unit 106, an erasing unit 108, a first tray 110, a second tray 112, ejecting members 114, 116, a first conveying path 118, a second conveying path 120, a third conveying path 122, a first branch member 124, a second branch member 126, an operation panel 128, a mark-printing unit 150, and a controller 200. In the following description, reuse means that the decoloring processing is performed to the sheet by the erasing apparatus 100 and the printing processing is performed to the sheet after the decoloring processing by an image-forming apparatus 300 described later.

The sheet-feeding tray 102 loads the sheet for reusing. The sheet for reusing, in other words, is the sheet to be decolored by the erasing apparatus 100. On the sheet to be decolored, the image is printed with the decolorable color material. The sheet-feeding tray 102 can load the sheet to be decolored of various sizes such as A4, A3, and B5. The sheet-feeding tray 102 includes a detection sensor 103. The detection sensor 103 detects presence of the sheet on the sheet-feeding tray 102. The sheet-feeding member 104 feeds the sheet loaded on the sheet-feeding tray 102 to the first conveying path 118 in the erasing apparatus 100, one by one. The sheet-feeding member 104 includes, for example, a pickup roller, a sheet-supplying roller, and a separation roller for supplying the sheet. The pickup roller takes out the sheet loaded on the sheet-feeding tray 102. The sheet-supplying roller supplies the taken-out sheet to the first conveying path 118. The separation roller is disposed to face the sheet-supplying roller and separates the sheet supplied by the sheet supplying roller one by one.

The first conveying path 118 includes a conveying path from the sheet-feeding tray 102 toward the first tray 110. The first conveying path 118 conveys the sheet supplied by the sheet-feeding member 104 to the reading unit 106 and the first tray 110.

The reading unit 106 is disposed along the first conveying path 118 at the sheet-conveying direction downstream side from the feeding tray 102. The reading unit 106 includes a reading device, for example, a charge coupled device (CCD), a scanner, or a complementary metal oxide semiconductor (CMOS). The reading unit 106 reads each of the images of first and second surfaces of the sheet to be conveyed through the first conveying path 118. The reading unit 106 includes two reading devices for reading images of both surfaces of the sheet. The two reading devices, as illustrated in FIG. 1, are disposed to face each other along the first conveying path 118 and via the first conveying path 118. Each position at which the two reading devices read the images of the sheet is referred to as a reading position. The reading positions of the two reading devices are disposed via the first conveying path 118 and do not face each other. Therefore, one reading device reads the image of the first surface of the sheet and then the other reading device reads the image of the second surface of the sheet. The controller 200 stores image data obtained by digitizing the image read by the reading unit 106 to a storage unit 204. Therefore, for example, when data of the image after the decoloring processing is required by a user, the erasing apparatus 100 can read the image data from the storage unit 204. Further, the controller 200, based on the image read by the reading unit 106, determines whether or not the image printed on the sheet is decolorable, or whether or not the sheet is reusable.

The first branch member 124 is disposed at a first branch position at the sheet conveying direction downstream side from the reading unit 106 in the first conveying path 118. The first branch member 124 switches a conveying direction of the sheet to be conveyed through the first conveying path 118. The first branch member 124 guides the sheet to be conveyed through the first conveying path 118 to the second conveying path 120 or the first tray 110 by switching the direction of the sheet. The second conveying path 120 is branched from the first conveying path 118 at the first branch position. The second conveying path 120 conveys the sheet to be guided by the first branch member 124 to the erasing unit 108. Further, the second conveying path 120 joins the first conveying path 118 at a joining position 121 at the sheet conveying direction upstream side from the reading unit 106 and the sheet conveying direction downstream side from the sheet-feeding tray 102. Therefore, the second conveying path 120 can convey the sheet conveyed from the reading unit 106 again to the reading unit 106 via the erasing unit 108. In other words, the erasing apparatus 100 can convey the sheet supplied from the sheet-feeding tray 102 by the sheet-feeding member 104 sequentially to the reading unit 106, the erasing unit 108, and the reading unit 106 by controlling the first branch member 124.

The second branch member 126 is disposed at a second branch position at the sheet conveying direction downstream side from the first branch member 124 in the first conveying path 118. The second branch member 126 switches the conveying direction of the sheet to be guided by the first branch member 124 and conveyed from the first conveying path 118. The second branch member 126 guides the sheet to be conveyed through the first conveying path 118 to the first tray 110 or the third conveying path 122 by switching the conveying direction of the sheet. The third conveying path 122 is branched from the first conveying path 118 at the second branch position. The third conveying path 122 conveys the sheet to be guided by the second branch member 126 to the second tray 112.

The erasing unit 108 decolors the image of the sheet to be conveyed through the second conveying path 120. For example, the erasing unit 108 decolors the image formed on the sheet with the decolorable color material by heating the sheet to the predetermined decoloring temperature in a state of being in contact with the sheet during conveyance. The erasing unit 108 includes two erasing devices 108*a*, 108*b* for erasing the image of the first surface of the sheet and for erasing the image of the second surface. The erasing devices 108*a*, 108*b* respectively include heater lamps 160, 161 that generate heat when electric power is supplied. The erasing devices 108*a*, 108*b*, as illustrated in FIG. 1, are disposed to face each other sandwiching the second conveying path 120. The erasing device 108*a* comes in contact with the sheet from the first surface side of the sheet to heat the sheet. The erasing device 108*b* comes in contact with the sheet from the second surface side of the sheet to heat the sheet. Namely, the erasing unit 108 performs the decoloring processing by decoloring the images of both surfaces of the sheet during conveyance in one conveyance. Each position is referred to as an erasing position in which the erasing devices 108*a*, 108*b* heat the sheet, namely, each position in which the heater lamps 160, 161 respectively included in the erasing devices 108*a*, 108*b* erase color of the image by applying heat to the sheet during conveyance. The positions of the erasing devices 108*a*, 108*b* do not face each other sandwiching the second conveying path 120. Therefore, the erasing device 108*a* performs the decoloring processing and then the erasing device 108*b* performs the decoloring processing. The erasing unit 108 includes temperature sensors 109*a*, 109*b*. The temperature sensors 109*a*, 109*b* respectively detect temperatures of the heater lamps 160, 161 of the erasing devices 108*a*, 108*b*. The temperature sensors 109*a*, 109*b* may be contact types or non-contact types.

The operation panel 128 is disposed on an upper portion of the erasing apparatus 100 body. The operation panel 128 includes a touch panel type display unit and various types of operation keys. The operation keys include numeric keys, for example. The operation panel 128 receives selection of a function of the decoloring apparatus 100 and an instruction of a processing start of the selected function by the user via the display unit or the operation keys. Therefore, the user can select the function of the erasing apparatus 100 and instruct the processing start of the selected function via the operation panel 128. The erasing apparatus 100, for example, as described later, includes function of performing reading processing besides the function of performing the decoloring processing. The operation panel 128 displays setting information of the erasing apparatus 100, an operation status, log information, or a message to the user, on the display unit. The operation panel 128 is not limited to the one to be disposed on the erasing apparatus 100 body. For example, the operation panel 128 may be an operation panel of an external apparatus to be connected with the erasing apparatus 100 via a network. Alternatively, the operation panel may be configured to be in an independent form from the erasing apparatus 100 body and connected with the erasing apparatus 100 by wired or wireless communication. The operation panel 128 of the embodiment may be any of the one that receives the instruction of the processing start by the user and the like, or allows the user to view the information, to the erasing apparatus 100.

The ejecting member 114 ejects the sheet to be conveyed through the first conveying path 118 to the first tray 110. The ejecting member 116 ejects the sheet to be conveyed through the third conveying path 122 to the second tray 112. The first tray 110 and the second tray 112 are disposed vertically in a lower part of the erasing apparatus 100 body as illustrated in FIG. 1. For example, the first tray 110 stores the sheet determined to be reusable by the controller 200 after the decoloring processing. The second tray 112 stores the sheet determined to be non-reusable by the controller 200 after the decoloring processing. Hereinafter, the first tray 110 is referred to as a reuse tray, and the second tray 112 is referred to as a reject tray. The reuse tray 110 and the reject tray 112 can switch the sheet to be stored. A setting of the sheet to be stored in each tray, namely, a setting of conveying destination of the sheet is set by the user via the operation panel 128, for example. Based on the setting of the tray, the controller 200 switches the sheet conveying direction to guide the sheet to the reuse tray 110 or the third conveying path 122, by controlling the second branch member 126.

The erasing apparatus 100 includes a plurality of sheet detection sensors 130, 131, 132, 133, 134 for detecting the sheet to be conveyed through the first to third conveying path 118, 120, 122. The sheet detection sensors 130-134, for example, are micro sensors or micro actuators. The sheet detection sensors 130-134 are disposed at appropriate positions of the first to third conveying path 118, 120, 122.

The controller 200 includes a processor 202 and a storage unit 204. The processor 202 includes a central processing unit (CPU) or a micro processing unit (MPU). The controller 200 controls the reading unit 106, the erasing unit 108, the operation panel 128, the first to third conveying path 118, 120, 122, and the first to second branch member 124, 126. The controller 200 further controls the mark-printing unit 150 described later. The storage unit 204 is a semiconductor memory, for example. The storage unit 204 includes read only memory (ROM), random access memory (RAM), and auxiliary storage. The ROM stores various control programs. The RAM provides a temporary work area for the processor 202. Further, for example, the ROM stores a printing rate of the sheet as a threshold of reusability determination. Further, the ROM stores a density threshold for determining whether or not the image has been decolored, and the like. The auxiliary storage temporarily or permanently stores the data of the image read by the reading unit 106. The above components of the erasing apparatus 100 are connected together via a control bus or a data bus.

The mark-printing unit 150 is disposed along the first conveying path 118, and between the first branch member 124 and the second branch member 126. The mark-printing unit 150 prints the mark including the printing information described later using the undecolorable color material to the sheet after the decoloring processing by the erasing unit 108. Specifically, the mark-printing unit 150, for example, prints an image of a two-dimensional bar code (hereinafter may be referred to simply as a bar code) as the mark. The undecolorable color material is a color material that is not decolored even when heated. The mark-printing unit 150 includes two mark printing devices. The two mark printing devices are disposed to sandwich the first conveying path 118. Therefore, although printing of the image of the bar code is possible to the first and second surfaces of the sheet, in the embodiment, the surface on which the image of the bar code is printed in one decoloring processing is only one surface of the first and second surfaces, as will be described later.

Since the image of the bar code is printed with the undecolorable color material, the image is not decolored even after the decoloring processing. Therefore, the sheet reused at least once is in a state that the image of the bar code in the previous decoloring processing has been printed. The mark-printing unit 150, when the image of the bar code has already been printed on the sheet, prints the image of the new bar code not to overlap the image of the existing bar code, for example, next to the image of the existing bar code side by side.

In contrast, the sheet reused for the first time, since the decoloring processing has not been performed even once, is in a state that the image of the bar code has not been printed. The mark-printing unit 150, when the image of the bar code has not been printed on the sheet, prints the image of the bar code, for example, in the margin of the lower left corner. The erasing apparatus 100, when printing the image of the first bar code on the sheet, treats the direction or portion of the sheet that enters the mark-printing unit 150 first as the upper direction or upper portion of the sheet, and treats the direction or portion of the sheet that enters the mark-printing unit 150 last as the lower direction or lower portion. On the contrary, when the image of the bar code has already been printed on the sheet, the position on which the image of the bar code has been printed is treated as the lower direction or lower portion of the sheet. Determination of whether or not the image of the bar code has already been printed is performed by the controller 200. The controller 200, for example, based on the image read by the reading unit 106, determines whether or not the image of the bar code has already been printed on the sheet. The controller 200, based on the determination result, controls the printing position of the image of the bar code by the mark-printing unit 150.

Namely, when the image of the bar code has already been printed on the sheet, the surface on which the image of the bar code has been printed becomes the surface on which the image of the new bar code is printed. Further, when the image of the bar code has not been printed on the sheet, one surface defined in advance becomes the surface on which the image of the new bar code is printed. In the following description, the surface of the sheet on which the image of the bar code is printed by the mark-printing unit 150 is referred to as a bar code printing surface.

Figure 2A:
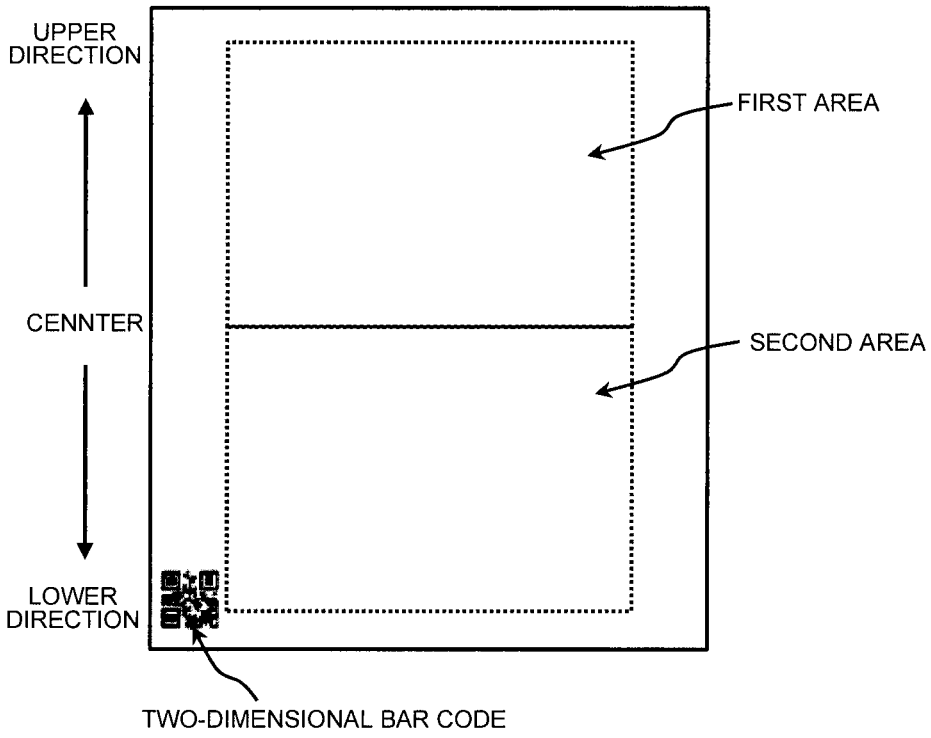
FIG. 2A illustrates first and second areas when the sheet to be used in the embodiment is partitioned.
Figure 2B:
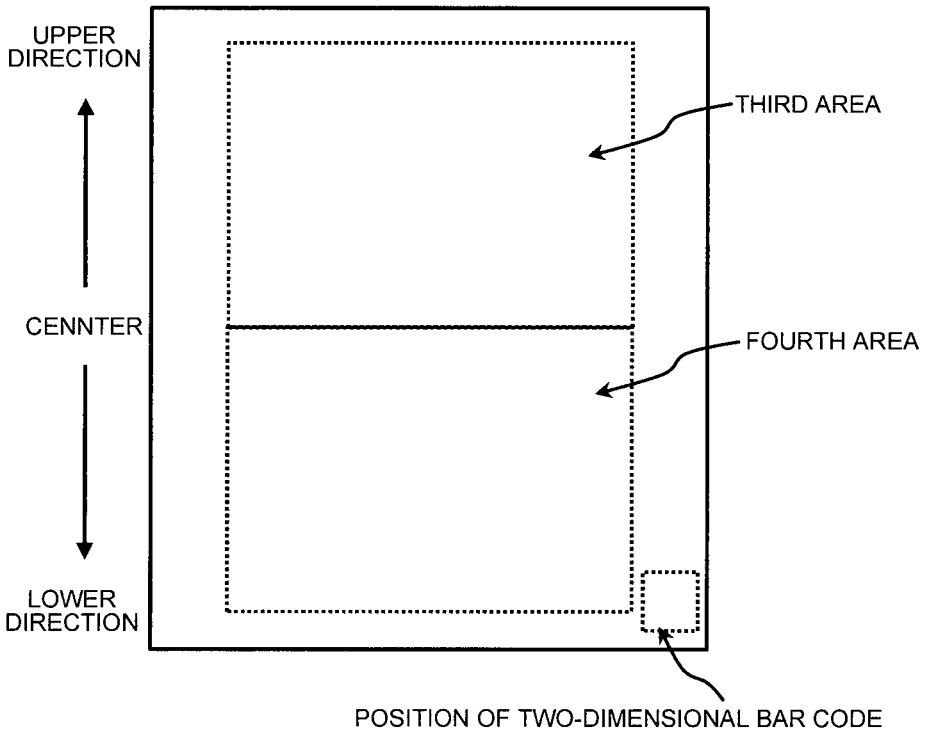
FIG. 2B illustrates third and fourth areas when the sheet to be used in the embodiment is partitioned.

The image of the bar code includes the printing information representing the image printing state such as which surface or area includes a large number of printed images or a small number of printed images in the sheet before the decoloring processing. The surface or area including a large number of printed images, for example, is a surface or area in which a printing rate described later is high. The surface or area including a small number of printed images, for example, is a surface or area in which a printing rate described later is low. Determination of which surface or area of the sheet includes a large number of printed images or a small number of printed images is performed by the controller 200. The controller 200 partitions one sheet into, for example, first to fourth areas for performing the determination that there is a large number of printed images or a small number of printed images. The first to fourth areas will be described with reference to FIG. 2A and FIG. 2B. FIG. 2A illustrates the first and second areas in the bar code printing surface of the sheet. The first area, as illustrated in FIG. 2A, is the area from the upper portion to the center of the sheet in the bar code printing surface of the sheet. The second area, as illustrated in FIG. 2A, is the area from the center to the lower portion of the sheet in the bar code printing surface of the sheet. In the following description, the area from the upper portion to the center of the sheet is referred to as a front stage area of the sheet, and the area from the center to the lower portion of the sheet is referred to as a rear stage area of the sheet. FIG. 2B illustrates the third and fourth areas in the opposite surface to the bar code printing surface of the sheet. The third area, as illustrated in FIG. 2B, is the front stage area of the sheet in the opposite surface of the sheet. The fourth area, as illustrated in FIG. 2B, is the rear stage area of the sheet in the opposite surface of the sheet. Namely, the controller 200 partitions one sheet into four areas in total by dividing the bar code printing surface into two areas vertically and dividing the opposite surface into two areas vertically as well.

The erasing apparatus 100, for example, includes functions of performing the reading processing, the decoloring processing, discriminating processing, and mark printing processing. The controller 200 of the erasing apparatus 100 achieves the functions of the processing by controlling the reading unit 106, the erasing unit 108, the mark-printing unit 150, and the other components, depending on selection of the function by the user received via the operation panel 128.

In the reading processing, the controller 200 stores data of the image of the entire surface of the sheet read by the reading unit 106 to the storage unit 204.

Further, in the reading processing, the controller 200 calculates for each of the first to fourth areas the printing rate of the printed image, based on data of the printed image included in the image data stored in the storage unit 204. The printed image is the image printed by the user on the sheet to be decolored. The printing rate, in the embodiment, refers to, but is not limited to, a ratio of the number of pixels of the area except sheet base color area to the number of pixels of the entire area. For example, when the image of the bar code does not exist in the image read by the reading unit 106, the controller 200, as described above, treats the predetermined one surface as the bar code printing surface, the front stage area of the bar code printing surface as the first area, and the rear stage area of the bar code printing surface as the second area. Further, the controller 200 treats the front stage area of the opposite surface to the bar code printing surface as the third area, and the rear stage area of the opposite surface to the bar code printing surface as the fourth area. In contrast, when the image of the bar code exists in the image read by the reading unit 106, the controller 200, as described above, treats the surface on which the image of the bar code has been printed as the bar code printing surface, the front stage area of the bar code printing surface as the first area, and the rear stage area of the bar code printing surface as the second area. Further, the controller 200 treats the front stage area of the opposite surface to the bar code printing surface as the third area, and the rear stage area of the opposite surface to the bar code printing surface as the fourth area. Namely, when the image of the bar code exists in the image read by the reading unit 106, the controller 200 decides the first to fourth areas depending on the position of the image of the bar code. Next, the controller 200 calculates the printing rate representing the image printing state of each of the first to fourth areas. In the mark printing processing described later, the controller 200 gives numerical values indicating printing rate order "4," "3," "2," "1" to the first to fourth areas in the descending order of the calculated printing rate.

In the decoloring processing, the controller 200 controls the erasing unit 108 for decoloring the image of the sheet by the erasing unit 108.

In the discriminating processing, the controller 200, based on the image read by the reading unit 106, determines whether or not the sheet is reusable. Specifically, for example, in the discriminating processing, the reading unit 106 reads the sheet after the decoloring processing by the erasing unit 108. The controller 200, based on the data of the image read by the reading unit 106, determines whether or not there is an image remaining on the sheet without being decolored. The controller 200, when it is determined that there is an image remaining undecolored on the sheet, in other words, there is a decoloring remainder, determines that the sheet after the decoloring processing is non-reusable. Further, for example, in the discriminating processing, the controller 200, based on the data of the image read by the reading unit 106, performs determination of depth of a wrinkle of the sheet and presence determination of a fold or a break of the sheet. The controller 200, when it is determined that the depth of the wrinkle is equal to or greater than a specified value or there is a fold, a break, or a hole in the sheet, determines that the sheet is non-reusable.

In the mark printing processing, the controller 200 generates image data of the bar code that is machine readable to the sheet determined to be reusable. The controller 200 adds information of the printing rate order as the printing information representing the image printing state to the image of the bar code to be generated. Specifically, the controller 200 gives high numerical value indicating the printing rate to the area in which the printing rate is the highest. For example, the controller 200 gives the numerical values "4," "3," "2," "1" to respective areas in the descending order of the printing rate. The controller 200 generates the image data of the bar code so that each of the areas to which the respective numerical values are given corresponds to the order of the printing rate. Hereinafter, the data indicating the printing rate order included in the image of the bar code may be referred to simply the printing rate order. The mark-printing unit 150 prints the image based on the image data of the bar code to be generated as described above on the sheet determined to be reusable.

Figure 3:
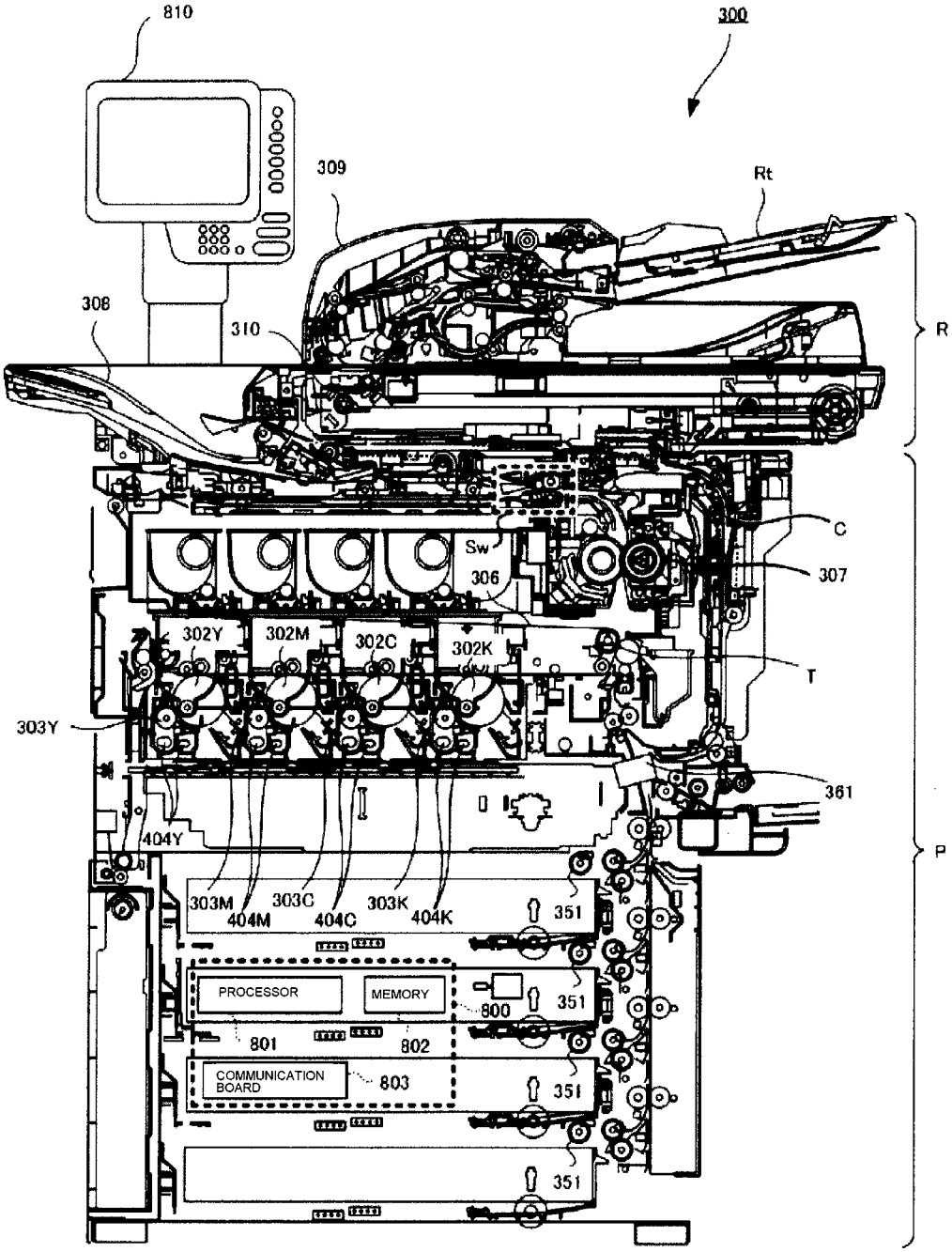
FIG. 3 is a schematic diagram illustrating an exemplary configuration of an image-forming apparatus according to the embodiment.

FIG. 3 is a vertical cross sectional view illustrating a schematic configuration of the image-forming apparatus according to the embodiment. The image-forming apparatus 300 illustrated in FIG. 3 is a multi-function peripheral (MFP). The MFP 300 includes a reading unit R and an image-forming unit P.

The reading unit R includes a function of reading the image to be printed by scanning a sheet document and book document. The image to be printed is an image of one surface. For example, in a case of the sheet illustrated in FIG. 4 described later, the image to be printed is an image of one surface including an image "A". The reading unit R includes a scanning optical unit 310 including a plurality of reflecting mirrors and an image sensor. Further, the reading unit R includes a document table and an auto document feeder (ADF) 309. The document table holds the sheet document and the book document set by the user. The ADF 309 includes a document tray Rt for holding the sheet document set by the user. The ADF 309 automatically conveys the sheet document held by the document tray Rt to a predetermined reading position. The scanning optical unit 310 reads the image to be printed of the sheet document and the book document held by the document table or the image to be printed of the sheet document to be conveyed to the reading position by the ADF 309 to output the image data to be printed.

The image-forming unit P, based on the image data to be printed output from the reading unit R and the image data to be printed transmitted to the MFP 300 from an external device, forms toner images of respective colors of yellow (Y), magenta (M), cyan (C), black (K) on the sheet. The image-forming unit P includes an exposing apparatus and process units for respective colors for forming the toner images. The process units for the respective colors include photoreceptors 302Y, 302M, 302C, 302K for the respective colors, and developing apparatuses for the respective colors, respectively. The developing apparatuses for the respective colors are provided to face the respective photoreceptors 302Y-302K. The developing apparatuses for the respective colors, for example, store the decolorable toners for the respective colors respectively for forming the toner images. The developing apparatuses for the respective colors include developing rollers 303Y, 303M, 303C, 303K, and mixers 404Y, 404M, 404C, 404K, respectively. The image-forming unit P further includes an intermediate transfer belt 306, a fixing apparatus 307, and an ejecting tray 308. Further, the image-forming unit 300 includes the sheet-feeding unit and a conveying unit. The sheet-feeding unit includes a plurality of sheet-feeding cassettes for storing the printing sheet and a pickup roller 351 for taking out the printing sheet from the sheet-feeding cassette. The conveying unit conveys the printing sheet taken out by the pickup roller 351 to a secondary transfer position T described later. The conveying unit includes the sheet conveying path and a plurality of conveying rollers provided along the sheet conveying path, for conveying the sheet.

The MFP 300 includes a controller 800. The controller 800 is a control board including a processor 801, a memory 802, a communication board 803, and the like. The processor 801, for example, is an arithmetic processing unit such as the CPU or the MPU. The processor 801 controls various types of processing in the MFP 300. The processor 801 achieves various functions by executing programs stored in the memory 802 in advance.

The memory 802 stores various types of information and programs used in the MFP 300. The memory 802 includes nonvolatile storage such as flash read only memory (FROM) or a hard disk drive, and volatile storage such as static random access memory (SRAM), dynamic random access memory (DRAM), or video RAM (VRAM).

The communication board 803 transmits/receives data to/from the external device via a telephone line and a local area network (LAN). The communication board 803 includes a network interface card (NIC) and a FAX modem. Further, the communication board 803 includes a terminal connectable to the external storage such as an external hard disk drive and universal serial bus (USB) memory.

Further, the MFP 300 includes a control panel 810. The control panel 810 receives an instruction and setting information from the user, and displays processing details in the MFP 300 to the user.

Hereinafter, processing of a copying function will be described as one example of basic operation of the MFP 300.

For example, sheet documents are set by the user, to the document tray Rt of the ADF 309. The MFP 300 receives a start instruction of the copying function by the user via the control panel 810. When the control panel 810 receives the start instruction, the controller 800 controls operation of each of the components of the MFP 300. For example, first, the pickup roller 351 takes out the printing sheet from the sheet-feeding cassette. The conveying unit conveys the sheet taken out by the pickup roller 351 toward the secondary transfer position T using the sheet-conveying path and the plurality of conveying rollers.

Meanwhile, the ADF 309 automatically conveys the sheet documents set to the document tray Rt to the reading position continuously. The scanning optical unit 309 reads the image to be printed of the sheet documents at the reading position.

The controller 800 performs predetermined image processing to the image data to be printed output from the reading unit R. The exposing apparatus, based on the image data to be printed to which the predetermined image processing has been performed, exposes the photoreceptors 302Y-302K. The exposing apparatus forms electrostatic latent images of each of the colors to the respective photoreceptors 302Y-302K by exposing.

The developing apparatus stirs the decolorable toner by the mixers 404Y-404K. The developing rollers 303Y-303K develop the electrostatic latent images of each of the colors by supplying the decolorable toner charged by being stirred to the photoreceptors 302Y-302K. By developing the electrostatic latent images of each of the colors, the decolorable toner images of each of the colors are formed on the photoreceptors 302Y-302K. Namely, by forming the decolorable toner images, the electrostatic latent images are visualized.

As described above, primary transfer of the decolorable toner images formed on the photoreceptors 302Y-302K is performed to the intermediate transfer belt 306. The intermediate transfer belt 306, by rotating, conveys the decolorable toner images to the predetermined secondary transfer position T. The sheet is conveyed to the secondary transfer position T by the conveying unit. At the secondary transfer position T, secondary transfer of the decolorable toner images is performed to the sheet from the intermediate transfer belt 306.

The conveying unit conveys the sheet to which the decolorable toner images are transferred further to the fixing apparatus 307. The fixing apparatus 307 fixes the decolorable toner images to the sheet by heating the decolorable toner images transferred to the sheet at a predetermined fixing temperature. The fixing temperature is lower than the decoloring temperature. The conveying unit ejects the sheet outside the MFP 300, by conveying the sheet to which the decolorable toner images are fixed further to the ejecting tray 308. The ejecting tray 308 holds the ejected sheet.

The image-forming unit P further includes a sheet-reversing unit for double-side printing. The sheet-reversing unit includes a switchback mechanism Sw and a circular conveying path C. The switchback mechanism Sw conveys the sheet to the circular conveying path C by moving the sheet backward, the sheet having the decolorable toner images fixed on the first surface (for example, front surface) of the sheet and being conveyed through the fixing apparatus 307 toward the ejecting tray 308. The circular conveying path C guides the sheet that has been passed through the fixing apparatus 307 to the secondary transfer position T again. The sheet-reversing unit conveys the sheet to the secondary transfer position T again through the circular conveying path C. The sheet-reversing unit may adopt a conventionally known technique.

The MFP 300, as described above, uses the decolorable toner as the toner of respective colors of Y, M, C, K. However, the toner used by the MFP 300 is not limited to the above. For example, the MFP 300 may use a normal undecolorable toner as the toner of respective colors of Y, M, C, K and use a decolorable toner of a predetermined color (generally blue). In this case, the MFP 300 includes one process unit using the decolorable toner besides a plurality of process units using the undecolorable toner. Further, the MFP 300 may be configured to include only one process unit using the decolorable toner.

Further, the MFP 300 includes a mark-reading unit 361. The mark-reading unit 361 is disposed at the conveying path near the sheet-feeding unit. Specifically, the mark-reading unit 361, as illustrated in FIG. 3, is disposed along the conveying path at the sheet-conveying direction downstream side from the pickup roller 351 of the sheet-feeding unit and the sheet-conveying direction upstream side from the secondary transfer position T. The mark-reading unit 361 reads the image of the bar code printed on the sheet by scanning the sheet to be supplied from the sheet-feeding unit. The mark-reading unit 361 outputs the image data of the read bar code to the controller 800. The controller 800 converts the image data of the bar code into numerical data or character data. The controller 800, based on the printing information included in the image of the bar code, acquires each printing rate order of the first to -fourth areas. When the printing sheet to be fed by the sheet-feeding unit is the sheet reused multiple times, images of multiple barcodes has been printed on the sheet. When the images of the multiple bar codes have been printed on the printing sheet, the controller 800, based on the printing information included in the images of the bar codes, aggregates the printing rate order for each of the first to fourth areas.

The controller 800, based on the acquired printing rate order (or aggregated value of the printing rate order) for each of the first to fourth areas, decides whether to print the image to be printed on any of the areas of the printing sheet. Specifically, the controller 800 recognizes that an area of large printing rate order is a frequently used area for printing, and an area of small printing rate order is an unused area or a less frequently used area. Therefore, the controller 800 decides the area of small printing rate order as the area for preferentially printing the image to be printed (hereinafter referred to as printing area). The controller 800 performs control processing including reversal of the printing sheet surface and rotation of the image data to be printed so that the image to be printed is printed on the decided printing area. The controller 800, by this printing control processing, suppresses printing on the frequently used area. The controller 800 performs the control processing so that the image to be printed is printed on the unused area or the less frequently used area.

Figure 4A:
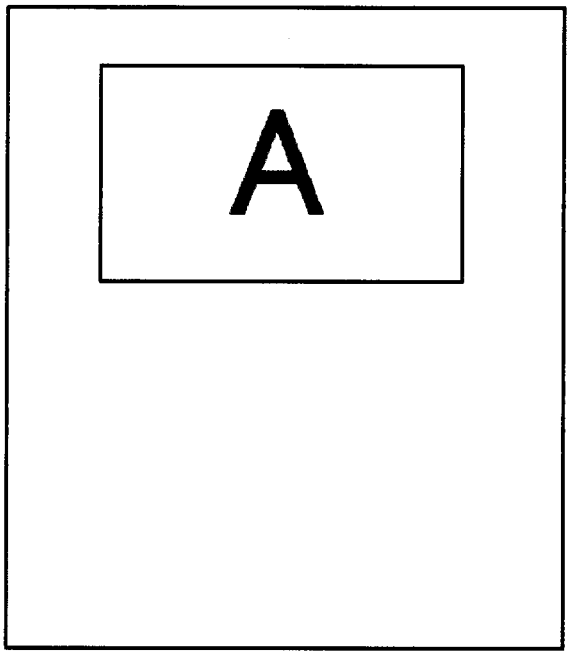
FIG. 4A illustrates a printing state of the sheet to be used in the embodiment.
Figure 4B:
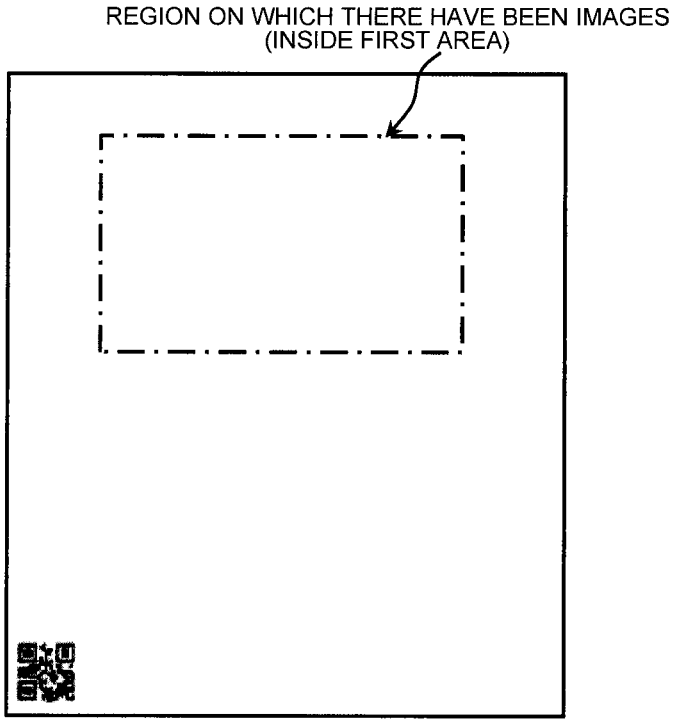
FIG. 4B illustrates a decolored state of the sheet to be used in the embodiment.

FIG. 4A illustrates one example of a printing state of the sheet after the printing processing by the MFP 300. FIG. 4B illustrates a decolored state that the decoloring processing and the mark printing processing have been performed by the decoloring apparatus 100 to the sheet illustrated in FIG. 4A. The MFP 300, as illustrated in FIG. 4A, prints an image "A" included in the image to be printed, for example, only on the first area of the sheet. The erasing apparatus 100 erases the image "A" visually from the area on which the image has been printed (the area illustrated by the dashed line), as illustrated in FIG. 4B, by performing the decoloring processing to the sheet of FIG. 4A to which the printing processing has been performed by the MFP 300. Further, the erasing apparatus 100 prints the image of the bar code at a position of lower left side of the sheet, as illustrated in FIG. 4B, by performing the mark printing processing. Specifically, the reading unit 106 of the decoloring apparatus 100 performs the reading processing to the sheet of FIG. 4A before the decoloring processing. In the sheet of FIG. 4A, image "A" has been printed only on the first area. Further, in the sheet of FIG. 4A, the bar code has not been printed. In other words, the sheet of FIG. 4A has not been reused before even once. Therefore, the controller 200 of the decoloring apparatus 100, based on the result of the reading processing, determines that the image of the bar code has not been printed on the sheet. Further, the controller 200, based on the result of the reading processing, calculates the printing rate of the first to fourth areas of the sheet. The controller 200, based on the calculation result, determines that the printing rate of the first area is the highest and the printing rates of the second-fourth areas are the lowest. The controller 200, based on the determination result, gives the largest numerical value "4" indicating the printing rate order to the first area, and gives the smallest numerical value "1" indicating the printing rate order to the second-fourth areas. The controller 200 converts the information of the printing rate order into a bar code. Therefore, the image of the bar code includes information of the printing rate order for each of the first to fourth areas as the printing information. The controller 200 generates image data of the bar code. The mark-printing unit 150 of the decoloring apparatus 100, based on the image data of the bar code, prints the image of the bar code at a predetermined position of the sheet (the lower left position of the sheet illustrated in FIG. 4B). Incidentally, when the image of the bar code has already been printed on the sheet of FIG. 4A, the controller 200, based on the result of the reading processing, determines the printing position of the image of the bar code that has already been printed. The mark-printing unit 150 prints the image of the bar code at a position shifted a predetermined distance from the determined printing position.

Figure 4C:
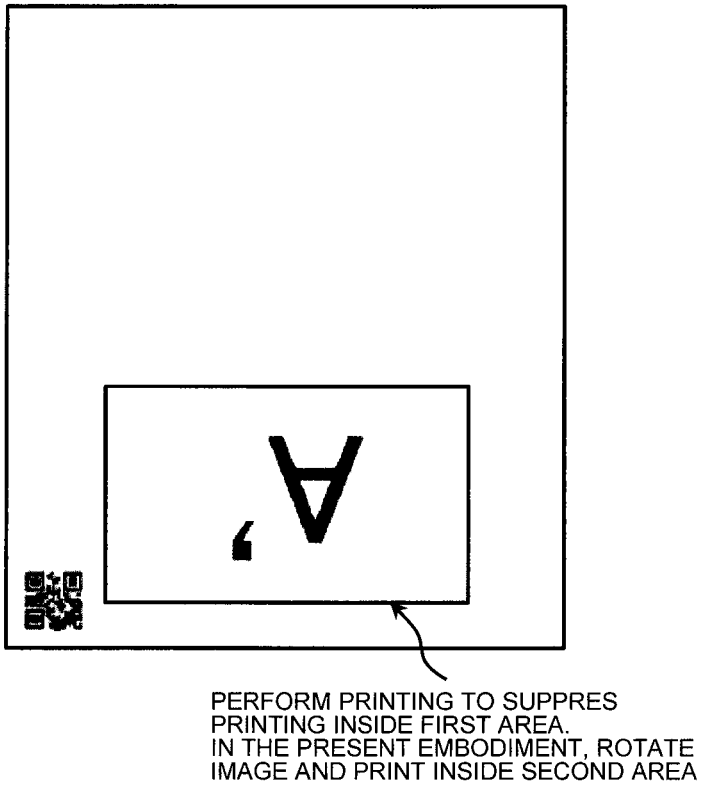
FIG. 4C illustrates a printing state of the sheet to be used in the embodiment.

FIG. 4C illustrates a printing state that the printing processing has been performed by the MFP 300 to the sheet illustrated in FIG. 4B. The MFP 300 prints an image in which an image "'A" included in the image to be printed has been rotated 180 degrees, for example, on the second area of the sheet, avoiding the first area, as illustrated in FIG. 4C, by performing the printing processing to the sheet of FIG. 4B to which the decoloring processing has been performed by the decoloring apparatus 100. Namely, the MFP 300 performs the printing processing of the image "'A" to suppress the printing processing to the first area of high printing use frequency. Specifically, the mark-reading unit 361 of the MFP 300 performs the reading processing of the image of the bar code to the sheet of FIG. 4B to be fed by the sheet-feeding unit. The controller 800 of the MFP 300 acquires information of the printing rate order for each area included in the image of the bar code read by the reading processing. The controller 800, based on the information of the printing rate order, identifies the area of the smallest printing rate order of the first to fourth areas. As described above, the numerical value 4 as the printing rate order has been given to the first area of the sheet, and the numerical value 1 as the printing rate order has been given to the second-fourth areas. Therefore, the controller 800 identifies the second-fourth areas as the areas of the smallest printing rate order. The controller 800 determines that the second-fourth areas that are the identified areas are the areas of small printing use frequency. The controller 800 decides the areas of small printing use frequency as the printing area. The controller 800 performs the printing control processing so that the printing state becomes the same as the original image of the image to be printed in the direction and printing position of the image to be printed. The printing control processing, for example, includes processing for rotating the image data to be printed, processing for changing the printing position in the sheet, and processing for reversing the sheet surface. The controller 800 prints the image to be printed and suppresses deviation of the printing use area in the sheet by performing the printing control processing to the decided printing area. However, as described above, when there is a plurality of areas of small printing use frequency, the controller 800 needs to decide any one of areas as the printing area. The controller 800 decides one printing area, for example, by considering the printing control processing required for each area. For example, when the second area is decided as the printing area, as the printing control processing, there is a need for the processing for changing the printing position in the sheet surface of the image "'A" included in the image to be printed, and the processing for rotating the image data to be printed. For example, when the third area is decided as the printing area, as the printing control processing, there is a need for the processing for reversing the front and back surfaces of the sheet, the processing for changing the printing position in the sheet surface, and the processing for rotating the image data to be printed. For example, when the fourth area is decided as the printing area, as the printing control processing, there is a need for the processing for reversing the front and back surfaces of the sheet. The processing for rotating the image data and the processing for changing the printing position of the image are performed by editing the data of the image "'A." In contrast, the processing for reversing the front and back surfaces of the sheet is performed, for example, by the above described sheet-reversing unit including the switchback mechanism Sw and the circular conveying path C. Therefore, the processing for reversing the front and back surfaces of the sheet requires processing time in comparison with the other processing. The controller 800, for example, considering the processing time, decides the second area as the printing area on which the image can be printed by performing the printing control processing that does not include the processing for reversing the front and back surfaces of the sheet. Incidentally, the method for deciding the printing area when there is a plurality of areas of small printing use frequency is not limited to the above.

Figure 5:
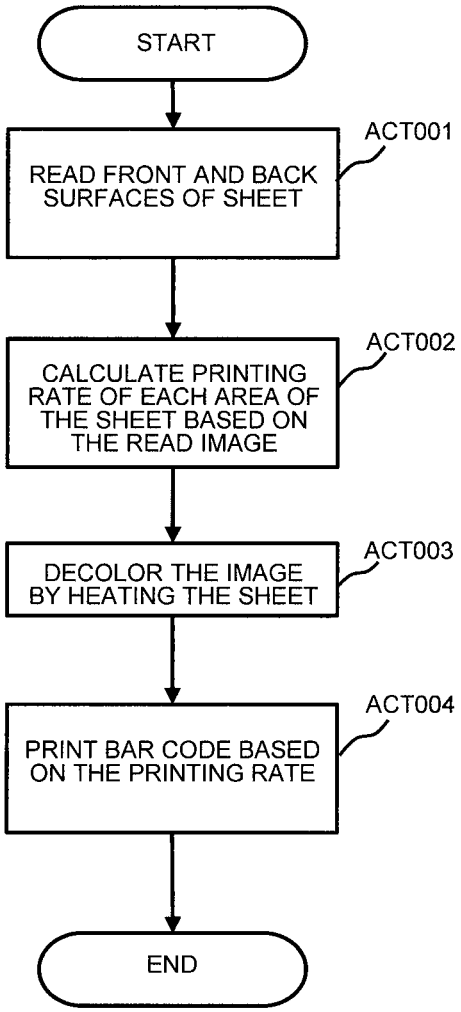
FIG. 5 is a flow chart illustrating decoloring processing of the erasing apparatus according to the embodiment.

Next, an operation example of the decoloring apparatus 100 and the MFP 300 will be described with reference to FIG. 5 and FIG. 6. FIG. 5 is a flow chart illustrating the operation example of the decoloring apparatus 100.

As illustrated in FIG. 5, in ACT001, the reading unit 106 of the erasing apparatus 100 obtains read images of both surfaces of the sheet by reading the front surface and the back surface of the sheet to be conveyed through the first conveying path 118 from the sheet-feeding tray 102. When the reading unit 106 obtains the read images of the both surfaces of the sheet, the operation of the erasing apparatus 100 proceeds to ACT002. In ACT002, the controller 200 detects a printing pattern from the read image. The controller 200, based on the detection result, calculates the printing rate of the first to fourth areas.

When the controller 200 calculates the printing rate of the first to fourth areas, the operation of the erasing apparatus 100 proceeds to ACT003. In ACT003, the erasing unit 108 decolors the image of the sheet to be conveyed through the second conveying path 120 by pressurizing and heating. The sheet after the decoloring processing by the erasing unit 108 is conveyed to the reading unit 106 again. The reading unit 106 performs the reading processing to the sheet after the decoloring processing again. The controller 200, based on the result of the reading processing, determines whether or not the sheet after the decoloring processing is reusable. When the erasing unit 108 performs the decoloring processing to the image of the sheet and the reading unit 106 performs the reading processing to the sheet after the decoloring processing, the operation of the erasing apparatus 100 proceeds to ACT004. In ACT004, the mark-printing unit 150 prints the image of the bar code including the information of the printing rate order of each area in the sheet, to the sheet determined to be reusable by the controller 200. The sheet on which the image of the bar code has been printed is ejected to the reuse tray 110. Meanwhile, the sheet determined to be non-reusable by the controller 200 is ejected to the reject tray 112, while the image of the bar code is not printed by the mark-printing unit 150. The erasing apparatus 100 ends the operation of the decoloring processing to one sheet by ejecting the sheet after the decoloring processing.

Figure 6:
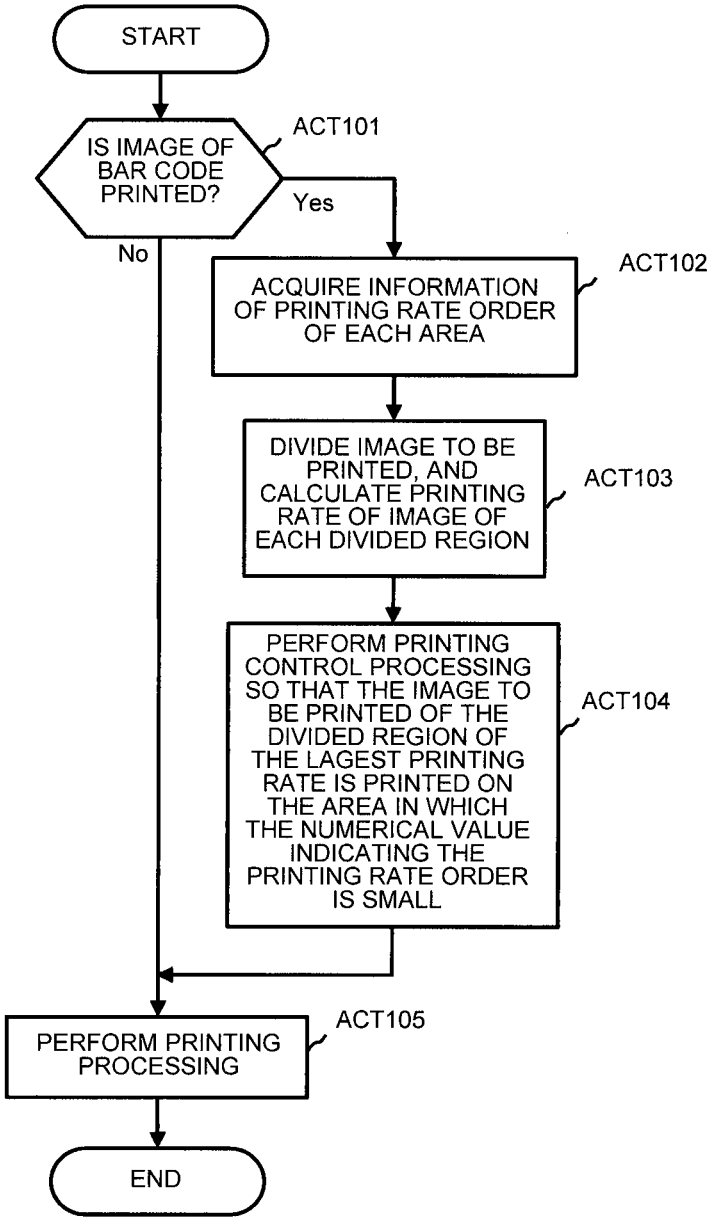
FIG. 6 is a flow chart illustrating printing processing of the image-forming apparatus according to the embodiment.

FIG. 6 is a flow chart illustrating an operation example of the MFP 300. As illustrated in FIG. 6, in ACT101, the mark-reading unit 361 of the MFP 300 reads the images of the both surfaces of the sheet to be conveyed from the sheet-feeding unit including the pickup roller 351. The controller 800, based on the data of the read image, determines whether or not the image of the bar code has been printed. When the controller 800 determines that the image of the bar code has not been printed on the sheet (ACT101: No), the operation of the MFP 300 proceeds to ACT105. In ACT105, the controller 800 performs the printing processing by controlling the image-forming unit P In other words, when the image of the bar code has not been printed on the sheet, the controller 800 does not perform the above described printing control processing.

In contrast, when the controller 800 determines that the image of the bar code has been printed (ACT101: Yes), the operation of the MFP 300 proceeds to ACT102. In ACT102, the controller 800, based on the image of the bar code included in the data of the read image, acquire the information of the printing rate order of the first to fourth areas of the sheet.

When the controller 800 acquires the information of the printing rate order of each area, the operation of the MFP 300 proceeds to ACT003. In ACT103, the controller 800 divides the image to be printed into, for example, images of four regions corresponding to the first to fourth areas of the sheet. The controller 800 calculates the printing rate of the image to be printed in each of the divided regions. Specifically, the controller 800 calculates the printing rate of an area from the upper end to the center of the image to be printed as the image of one region, and also calculates the printing rate of an area from the center to the lower end of the image to be printed as the image of one region. When printing both surfaces, the controller 800 further performs similar image division of the region to the image to be printed of the next page, and calculates each printing rate.

When the controller 800 calculates each printing rate of the divided regions of the image to be printed, the operation of the MFP 300 proceeds to ACT104. In ACT104, the controller 800 performs the printing control processing such as reversing the sheet surface and rotating the image data to be printed so that the image to be printed of the divided region of the largest printing rate is printed on the area in which the numerical value indicating the printing rate order is small. In other words, the controller 800 performs the printing control processing such as reversing the sheet surface and rotating the image data to be printed so that the image to be printed of the divided region of the largest printing rate is printed on the area of the sheet in which the printing rate is low. Alternatively, the controller 800 may perform the printing control processing such as reversing the sheet surface and rotating the image data to be printed so that the image to be printed of the divided region of the smallest printing rate is printed on the area in which the numerical value indicating the printing rate order is large. In other words, the controller 800 may perform the printing control processing such as reversing the sheet surface and rotating the image data to be printed so that the image to be printed of the divided region of the smallest printing rate is printed on the area of the sheet in which the printing rate is high. Namely, the controller 800 performs processing for suppressing image-forming to the area of the sheet on which the largest number of images have been printed (area of large printing use frequency). When the controller 800 performs the printing control processing, the operation of the MFP 300 proceeds to ACT105. In ACT105, as described above, the controller 800 performs the printing processing by controlling the image-forming unit P.

The erasing apparatus according to the embodiment divides one sheet into four areas of the first to fourth areas for calculating the printing rate of the sheet before the decoloring processing, but the number of areas is not limited thereto. The erasing apparatus may further subdivide the area of the sheet within a range in which there is a margin in allowable data capacity of the bar code to be printed on the sheet after the decoloring processing. Further, the image-forming apparatus according to the embodiment performs the control for suppressing the deviation of the printing use area in the sheet over the both surfaces of the sheet, but the suppression control method is not limited thereto. For example, the image-forming apparatus may perform the control for suppressing the deviation of the printing use area in the sheet only on one surface (front surface or back surface). Further, the image-forming apparatus may perform only reversing processing of the sheet surface as the suppression control by determining the entire front surface as the first area and determining the entire back area as the second area.

According to the embodiment, it is also possible to provide the sheet-reuse system including the decoloring apparatus and the image-forming apparatus. The name of the system, for example, but is not limited to, may be a sheet-regeneration system, a decoloring system, and an image-forming system.

Further, the mark is not limited to the bar code image, being printed by the erasing apparatus according to the embodiment on the sheet after the erasing processing. The mark may be any of aspects that can include the information representing which area has a large number of printed images of the area obtained by plurally dividing the sheet surface and is machine-readable. The mark, in addition to the two-dimensional bar code, for example, may be a one-dimensional bar code, a character string, and a numerical value.

As described above, the embodiment can suppress the deviation of the printing use area in the sheet, and achieves efficient sheet reuse.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet-reuse system comprising:

an erasing apparatus; and an image-forming apparatus, and wherein the erasing apparatus includes a first reading unit configured to read an image printed on a sheet using an erasable color material, an erasing unit configured to erase the image printed on the sheet, a first controller configured to generate a mark, including printing information representing an image printing state of at least one area of a plurality of areas of a surface of the sheet before an erasing processing by the erasing unit, based on the image read by the first reading unit, and a mark-printing unit configured to print the mark on the sheet, and wherein the image-forming apparatus includes an image-forming unit configured to form an image to be printed using the erasable color material on the sheet after the erasing processing by the erasing apparatus, a second reading unit configured to read the mark from the sheet after the erasing processing by the erasing apparatus, before an image-forming processing by the image-forming unit, and a second controller configured to acquire the printing information from the mark read by the second reading unit and, based on the acquired printing information, to perform control such that the image to be printed by the image-forming unit is formed on an area of the sheet different from one of the plurality of areas on which a large number of images have been printed before the erasing processing.

2. The sheet-reuse system according to claim 1, wherein the first controller partitions the surface of the sheet before the erasing processing by the erasing unit into the plurality of areas, calculates a printing rate of the image of each area, and generates the mark including information of the calculated printing rate of each area as the printing information.

3. The sheet-reuse system according to claim 2, wherein the second controller acquires the information of the printing rate of each area of the sheet as the printing information from the mark read by the second reading unit and, based on the acquired information of the printing rate, determines the area on which the largest number of images have been printed of the plurality of areas in the sheet before the erasing processing, and decides an area other than the determined area as a printing area for preferentially printing the image to be printed.

4. The sheet-reuse system according to claim 3, wherein the second controller changes the printing position of the image to be printed such that a high printing rate portion of the image to be printed is formed on the printing area.

5. The sheet-reuse system according to claim 3, wherein the second controller rotates the image to be printed for changing the direction of the image to be printed.

6. The sheet-reuse system according to claim 3, wherein the second controller reverses the surface of the sheet such that the high printing rate portion of the image to be printed is formed on the printing area.

7. The sheet-reuse system according to claim 2, wherein the second controller, based on a reading result by the second reading unit, when determined that a plurality of the marks exists, determines the area on which the largest number of images have been printed of the plurality of areas of the sheet before the erasing processing by aggregating the information of the printing rate included in each of the plurality of the marks.

8. The sheet-reuse system according to claim 1, wherein the first controller, based on the image read by the first reading unit, determines presence of the mark already printed on the sheet before the erasing processing and, when the mark exists, determines a printing position of the mark in the sheet, and the mark-printing unit, when the mark does not exist on the sheet before the erasing processing, prints the mark at a predetermined position of the sheet and, when the mark exists on the sheet, prints the mark at a position shifted a predetermined distance from the determined printing position.

9. An erasing apparatus comprising:

a reading unit configured to read an image printed on a sheet using an erasable color material;

an erasing unit configured to erase the image printed on the sheet;

a controller configured to generate a mark including printing information representing an image printing state of at least one area of a plurality of areas of a surface of the sheet before an erasing processing by the erasing unit, based on the image read by the reading unit, the image printing state indicating at least one of:

at least one area of the plurality of areas on which a largest number of images have been printed before the erasing processing, among the plurality of areas, and at least one area of the plurality of areas on which a smallest number of images have been printed before the erasing processing, among the plurality of areas; and a mark printing unit configured to print the mark on the sheet.

10. The erasing apparatus according to claim 9, wherein the controller partitions the surface of the sheet before the erasing processing by the erasing unit into the plurality of areas, calculates a printing rate of the image of each area, and generates the mark including information of the calculated printing rate of each area as the printing information.

11. The erasing apparatus according to claim 10, wherein the controller, based on the image read by the reading unit, determines presence of the mark already printed on the sheet before the erasing processing and, when the mark exists, determines a printing position of the mark in the sheet, and the mark printing unit, when the mark does not exist on the sheet before the erasing processing, prints the mark at a predetermined position of the sheet and, when the mark exists, prints the mark at a position shifted a predetermined distance from the determined printing position.

12. The erasing apparatus according to claim 9, wherein the mark-printing unit prints the mark on the sheet, using an inerasable color material.

13. An image-forming apparatus configured to form an image on a sheet from which an image has been erased by an erasing apparatus, comprising:

an image-forming unit configured to form an image to be printed using an erasable color material, on the sheet after the erasing processing;

a reading unit configured to read a mark including printing information representing an image-printing state of at least one area of a plurality of areas of a surface of the sheet before the erasing processing from the sheet after the erasing processing, before image-forming processing by the image-forming unit; and a controller configured to acquire the printing information from the mark read by the reading unit and, based on the acquired printing information, to perform control such that the image to be printed by the image-forming unit is formed on an area of the sheet different from one of the plurality of areas on which a large number of images have been printed before the erasing processing.

14. The image-forming apparatus according to claim 13, wherein the controller acquires the information of the printing rate of the image of each area of the sheet as the printing information from the mark read by the reading unit and, based on the acquired information of the printing rate, determines the area on which the largest number of images have been printed of the plurality of areas in the sheet before the erasing processing, and decides an area other than the determined area as a printing area for preferentially printing the image to be printed.

15. The image-forming apparatus according to claim 14, wherein the controller, based on a reading result by the reading unit, when determined that a plurality of the marks exists, determines the area on which the largest number of images have been printed of the plurality of areas of the sheet before the erasing processing by aggregating the information of the printing rate included in each of the plurality of the marks.

16. The image-forming apparatus according to claim 14, wherein the controller changes the printing position of the image to be printed such that a high printing rate portion of the image to be printed is formed on the printing area.

17. The image-forming apparatus according to claim 16, wherein the second controller reverses the surface of the sheet such that the high printing rate portion of the image to be printed is formed on the printing area.

18. The image-forming apparatus according to claim 14, wherein the controller rotates the image to be printed for changing the direction of the image to be printed.

* * * * *